United States Patent [19]

Ehret et al.

[11] Patent Number: 4,927,179

[45] Date of Patent: May 22, 1990

[54] SHIPPING LABEL WITH PRICE TAG SECTION

[75] Inventors: Barbara A. Ehret, Seattle; James H. Pearce, III, Rothell, both of Wash.

[73] Assignee: Uarco Incorporated, Barrington, Ill.

[21] Appl. No.: 289,700

[22] Filed: Dec. 27, 1988

[51] Int. Cl.[5] ..... B42D 15/00

[52] U.S. Cl. ..... 283/79; 283/101; 283/105; 283/81

[58] Field of Search ..... 283/79, 81, 80, 74, 283/56, 98, 101, 105; 40/594, 593, 643, 644; 156/249, 289; 428/40

[56] References Cited

U.S. PATENT DOCUMENTS

| | | | |
|---|---|---|---|
| 3,343,851 | 12/1965 | Bensler, Sr. et al. | 281/5 |
| 3,370,365 | 2/1968 | Vosbikian | 40/10 |
| 3,481,460 | 12/1969 | Watts | 206/56 |
| 3,920,122 | 11/1975 | Koehlinger et al. | 206/390 |
| 3,950,580 | 4/1976 | Boudet | 428/41 |
| 3,963,124 | 6/1976 | Banks | 206/527 |
| 3,993,814 | 11/1976 | Cavender | 428/40 |
| 4,110,562 | 8/1978 | Baer | 428/40 |
| 4,270,291 | 6/1981 | Babberl | 40/594 |
| 4,305,216 | 12/1981 | Skelton | 40/10 |
| 4,306,367 | 12/1981 | Otto | 40/312 |
| 4,446,182 | 5/1984 | Cavender | 428/40 |
| 4,711,686 | 12/1987 | Instance | 156/227 |
| 4,747,618 | 5/1988 | Instance | 281/5 |

*Primary Examiner*—Douglas D. Watts
*Assistant Examiner*—Tom Hamill, Jr.
*Attorney, Agent, or Firm*—Wood, Phillips, Mason, Recktenwald & VanSanten

[57] ABSTRACT

Mix-ups in the pricing of merchandise are avoided in a combination shipping label and price tag construction including a first ply 16 of release liner material and a second ply 24 of label stock having a pressure sensitive adhesive 26 on one side thereof releasably adhered to the release liner ply 16. The label stock ply 24 has a shipping label section 28 and a price tag section 30. The price tag section includes a plurality of individual and separable price tags 40 and has a dimension "d" that is less than the corresponding dimension "D" of the shipping label section 28 and which is closely adjacent the shipping label section and is at least nominally centered with respect to one edge 36 thereof. A closed line of perforation 44 in the release liner ply 16 includes generally parallel sections 50, 52 spaced apart a distance equal to or somewhat greater than the distance "d" and extends in a frame-like pattern within at least two opposed sides of the shipping label section 28 and about the periphery of three sides of the price tag section 30.

10 Claims, 1 Drawing Sheet

FIG. 1
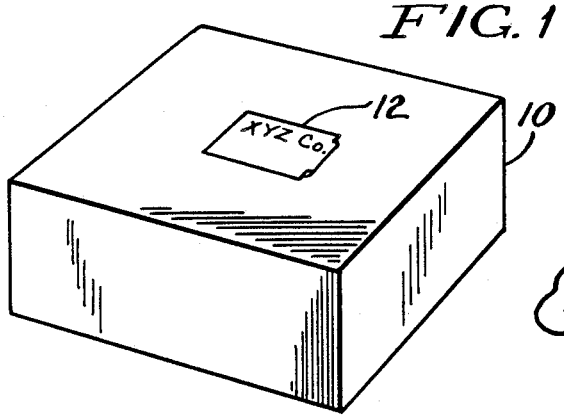
FIG. 2
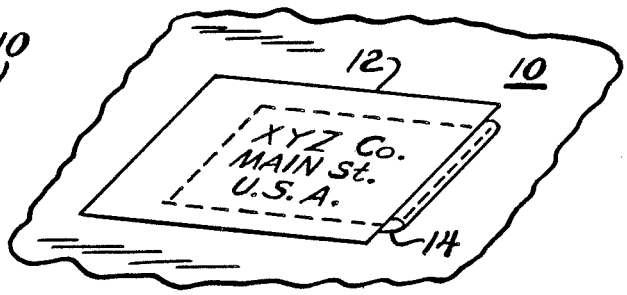
FIG. 3
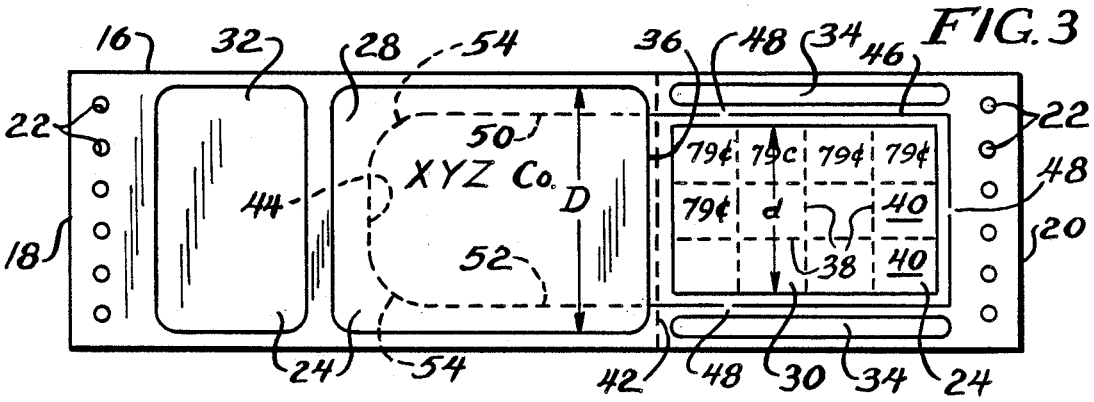
FIG. 4
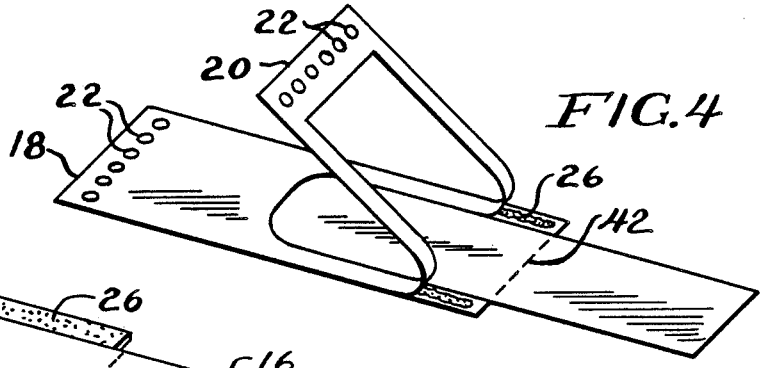
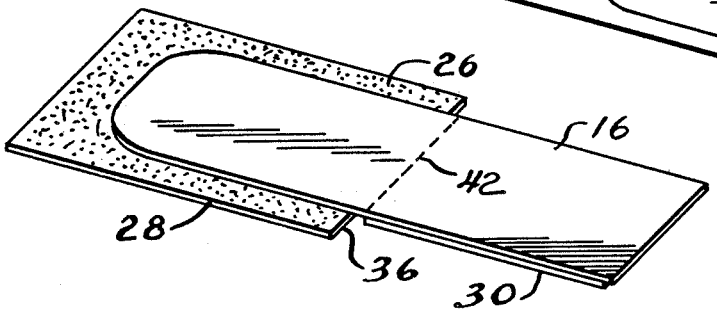
FIG. 5
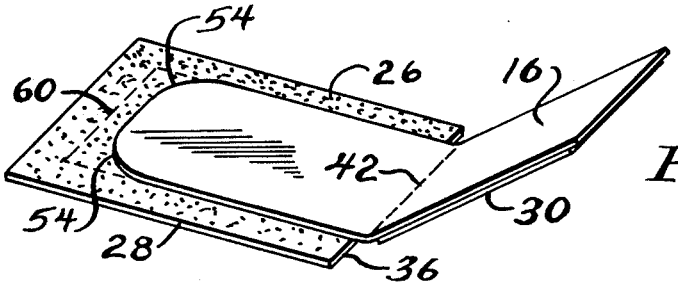
FIG. 6

SHIPPING LABEL WITH PRICE TAG SECTION

FIELD OF THE INVENTION

This invention relates to a business form of the pressure sensitive adhesive type that is usable in the shipping of merchandise for subsequent sale.

BACKGROUND OF THE INVENTION

Retailing concerns having a plurality of outlets at differing locations frequently ship merchandise for resale by the outlets from a central location. When the merchandise arrives at a given outlet, it must be unpacked and then must be priced as, for example, by the placing of price tags on the merchandise or the packages therefor.

Not infrequently, because of the larger scale of the central shipping operation, it is more expeditious and economical to print the price tags at that single location rather than at the individual outlets to which the merchandise is shipped. This in turn means that the printed price tags must be shipped with the merchandise to the various outlets.

A number of problems result from the foregoing. For one, two different printing runs are required, one for printing the shipping label and another for printing the price tags. Secondly, mistakes may occur wherein the wrong price tags become associated with a given shipping container and if not noticed, the merchandise would be inappropriately priced.

Furthermore, this process generally requires that the containers for the merchandise be opened and stuffed with the price tags and then reclosed.

On attempt to solve this problem is disclosed in U.S. Pat. No. 4,110,502 issued Aug. 29, 1978 to Baer. However, the Baer device is difficult to manufacture and not particularly easy to use since it involves the exposure of pressure sensitive adhesive over the entirety of one side of a large panel.

The present invention is directed to overcoming the above problems.

SUMMARY OF THE INVENTION

It is the principal object of the invention to provide a new and improved business form of the pressure sensitive adhesive type that may be used for shipping merchandise for subsequent sale. More particularly, it is an object of the invention to provide such a business form that is a combination shipping label and price tag providing form.

An exemplary embodiment of the invention achieves the foregoing object in a construction including a first ply of release liner material and a second ply of label stock having pressure sensitive adhesive on one side thereof which is releasably adhered to the release liner. The label stock ply has a shipping label section and a price tag section and the price tag section in turn comprises a plurality of individual, separable price tags. The price tag section has one dimension that is less than the corresponding dimension of the shipping label section and is closely adjacent to the shipping label section and at least nominally centered with respect to one edge thereof that is parallel to the direction of the dimensions referred to immediately preceding.

A closed line of perforation is located in the release liner ply and defines a frame. Part of the frame extends about three sides of the price tag section and within at least two opposed sides of the shipping label section. As a consequence, the shipping label section and the price tag section may be printed upon simultaneously and thereafter, that part of the release liner defining the frame can be removed to expose pressure sensitive adhesive only on the sides of the shipping label section. The price tag section may then be folded along the aforementioned edge under the shipping label section and the shipping label section adhered to a shipping container by the exposed pressure sensitive adhesive at the sides thereof in superimposed relation to the price tag section.

In a highly preferred embodiment, the frame extends within three sides of the shipping label section so that removal thereof exposes adhesive on three sides of the shipping label section.

In a preferred embodiment of the invention, the shipping label section and the price tag section are connected only by the release liner ply.

In this embodiment of the invention, a line of weakness is located in the release liner ply between the shipping label section and the price tag section.

In a highly preferred embodiment, the frame is configured such that part of the release liner ply that abuts the price tag section when folded upon itself, will contact some of the exposed adhesive and may releasably adhere thereto.

The individual price tags are defined by lines of perforation in the price tag section.

Other objects and advantages will become apparent from the following specification taken in connection with the accompanying drawings.

DESCRIPTION OF THE DRAWINGS

FIG. 1 is a perspective view of a shipping container bearing a business form made according to the invention;

FIG. 2 is an enlarged, fragmentary perspective view of that part of the container bearing the business form;

FIG. 3 is a plan view of the business form of the invention ;

FIG. 4 is a perspective view of the back side of the form in process of having part of a release liner removed therefrom;

FIG. 5 illustrates the business form in perspective from the side thereof after the release liner frame has been removed therefrom; and FIG. 6 is a view similar to FIG. 5 but illustrating part of the business form being folded upon itself preliminary to being applied to a shipping container.

DESCRIPTION OF THE PREFERRED EMBODIMENT

An exemplary embodiment of a business form made according to the invention is illustrated in the drawings. The business form is ideally suited for application to a shipping container such as shown at 10 in FIG. 1. The business form includes a shipping label 12 applied to the container 10 so that the latter will be delivered to the proper destination.

As can be seen in FIG. 2, a flap 14 is folded under the shipping label 12 and contains price tag material as will be seen. As a consequence of this construction, upon arrival of the container at its destination, it may be opened and the label 12 removed so as to expose the flag 14. As will be seer, price tags on the flap 14 may then be applied to the various items of merchandise contained within the shipping container 10.

Turning now to FIG. 3, the business form of the invention includes a rectangular panel or ply 16 of release liner material. The release liner material is conventional and includes a waxy surface to which conventional pressure sensitive adhesive systems will releasably adhere.

As illustrated in FIG. 3, opposite longitudinal edges 18 and 20 of the release liner ply are provided with pin feed or line holes 22 which may be utilized in the manufacture of the form as well as in subsequent processing of the form in the hands of the user.

Releasably adhered to the release liner ply 16 is a label stock ply 24. The label stock ply 24 includes, on one side thereof, pressure sensitive adhesive 26 (FIG. 4) by which the ply 24 is releasably adhered to the ply 16.

As can be readily seen in FIG. 3, the ply 24 is not a unitary structure. Rather it includes several sections including a shipping label section 28 and a price tag section 30.

Optionally, the label stock ply 24 may include an extraneous label section 32 as well as relatively long, narrow waste sections 34. The various sections are formed as by die cutting the ply 24 and then removing the material that exists between the sections in a conventional fashion.

The shipping label section 28 and the price tag section 30 are both rectangular in configuration. The top to bottom dimension of the price tag section 30, "d", is less than the corresponding dimension "D" of the shipping label section 28. It will be also observed that the price tag section 30 is nominally centered with respect to the edge 36 of the shipping label section 28 that is parallel to the dimension "D". Further, the price tag section 30 is in close adjacency to the edge 36.

As can be seen in FIG. 3, the price tag section 30 includes a plurality of intersecting lines of perforation 38 which define individual and separable price tags 40, there being twelve such tags illustrated in FIG. 3.

A line of weakness in the form of a perforation 42 is located in the release liner ply 16 between the shipping label section 28 and the price tag section 30 and the purpose of the same is to facilitate folding of the latter upon the former as will be seen.

The construction is basically completed by a closed line of perforation 44 in the release liner ply 16. The line of perforation 44 preferably includes extremely long slits separated by only a relatively few ties 48 which may be readily broken. It includes two relatively parallel sections 50 and 52 which are spaced apart a distance slightly greater than the distance "d" and less than the distance "D". As can be seen in FIG. 3, the line of perforation extends about three sides of the periphery of the price tag section 30, that is, it passes between the waste sections 34 and the price tag section 30 and along the right hand end of the latter. It also passes within three of the side edges of the shipping label section 28. In this respect, it should be noted that rounded corners 54 are located in the closed loop line of perforation 44 at a location most remote from the price tag section 30.

In use, a plurality of individual form lengths such as shown in FIG. 3 will be connected by lines of weakening as is well known and then fed through a printer. At this time, shipping label information can be imprinted or the shipping label section 28 while price tag information can be printed on the individual price tags 40 as desired. Simultaneously, if the optional label 32 is to be used for any, purposes, it may be printed upon at the same time. For example, it may be desirable to print legends or symbols on the label 32 to the effect of "This Side Up" or "Fragile" or the like.

After that has been accomplished, the business form may be separated into individual form lengths. After inverting the form, the edge 20 may be grasped and pulled back as illustrated in FIG. 4. This results in exposing the adhesive 26 on at least two opposed side edges of the shipping label section 28 and, for the specific configuration described to date, a U-shaped pattern of adhesive 26 as is illustrated in FIG. 5. The price label section 30 and its backing release liner 16 may then be folded along the line of weakening 42 to abut that portion of the release liner 16 backing the shipping label section 28, the initiation of which procedure is illustrated in FIG. 6. In the preferred embodiment, the rounded corners 54 are such that when folded back, part of the release liner 16 backing the price tag section 30 will overlie the pressure sensitive adhesive 26 in an area bounded by a dotted line shown at 60 in FIG. 6. As a result, the release liner 16 backing the price tag section 30 will releasably adhere to the pressure sensitive adhesive 26 in this area.

After that has occurred, the assemblage may be secured by the adhesive 26 to a shipping container 10. In the embodiment illustrated, such adherence will occur about three sides of the shipping label section 28. It will, of course, be superimposed over the price tag section which will then be hidden from view and protected by the shipping label section 28.

Because the price tag section 30 is adhered to the adhesive 26 in the area bounded by the line 60, and is otherwise completely hidden by the shipping label section 28, it cannot be eased out from underneath the latter without such occurrence being observed. As a consequence, the confidentiality of pricing information contained on the price tag section 30 is assured.

In addition, because both sections may be printed upon simultaneously, separate printing operations are eliminated, only one run through a computer printer or the like being required. And because the address information and pricing information are all on a single form length, it is impossible to miscorrelate the pricing information with the shipping information.

We claim:

1. A pressure sensitive adhesive business form for use in shipping merchandise for subsequent sale comprising:

a first ply of release liner;

a second ply of label stock and having a pressure sensitive adhesive on one side thereof releasably adhered to said first ply;

said label stock ply having a shipping label section and a price tag section;

said price tag section comprising a plurality of individual and separable price tags, and having one dimension that is less than the corresponding dimension of said shipping label section and being closely adjacent said shipping label section and at least nominally centered with respect to one edge thereof that is parallel to the direction of said dimensions; and a closed line of perforation in said release liner ply including generally parallel sections spaced apart a distance equal to or somewhat greater than said price tag section one dimension which extend in a frame-like pattern within at least two opposed sides of said shipping label section and about the periphery of three sides of said price tag section;

whereby said shipping label section and said price tag section may be printed upon simultaneously and thereafter, that part of said release liner defining said frame-like pattern removed to expose pressure sensitive adhesive on said two opposed sides of said shipping label section, said price tag section folded along said edge and under said shipping label section and said shipping label section adhered to a shipping container by said exposed pressure sensitive adhesive in superimposed relation to said price tag section.

2. The business form of claim 1 wherein said frame-like pattern extends within three sides of said shipping label section so that removal thereof exposes adhesive on three sides of said shipping label section.

3. The business form of claim 2 wherein said frame-like pattern is configured such that the part of the release liner ply abutting said price tag section, when folded upon said shipping label section, will contact some of said exposed adhesive and may releasably adhere thereto.

4. The business form of claim 1 wherein said individual price tags are defined by lines of perforation in said price tag section.

5. The business form of claim 1 wherein a line of weakening separates said shipping label section and said price tag section.

6. The business form of claim 5 wherein said line of weakening is in said release liner ply.

7. A pressure sensitive adhesive business form for use in shipping merchandise for subsequent sale comprising:

a first ply of release liner;

a second ply of label stock and having a pressure sensitive adhesive on one side thereof releasably adhered to said first ply;

said label stock ply having a shipping label section and a price tag section;

said price tag section comprising a plurality of individual and separable price tags, and having one dimension that is less than the corresponding dimension of said shipping label section and being closely adjacent said shipping label section and at least nominally centered with respect to one edge thereof that is parallel to the direction of said dimensions; and a closed line of perforation in said release liner ply defining a frame, part of said frame extending about three sides of said price tag section and within at least two opposed sides of said shipping label section;

whereby said shipping label section and said price tag section may be printed upon simultaneously and thereafter, that part of said release liner defining said frame removed to expose pressure sensitive adhesive on said two opposed sides of said shipping label section, said price tag section folded along said edge and under said shipping label section and said shipping label section adhered to a shipping container by said exposed pressure sensitive adhesive in superimposed relation to said price tag section.

8. The business form of claim 7 wherein said frame is configured such that the part of the release liner ply abutting said price tag section, when folded upon said shipping label section, will contact some of said exposed adhesive and may releasably adhere thereto.

9. The business form of claim 7 wherein said shipping label section and said price tag section are connected only by said release liner ply.

10. The business form of claim 9 including a line of weakness in said release liner ply between said shipping label section and said price tag section.

* * * * *